United States Patent [19]

Furtak et al.

[11] Patent Number: 5,056,195

[45] Date of Patent: Oct. 15, 1991

[54] MINERAL FIBER COLLECTION PROCESS AND DEVICE

[75] Inventors: Hans Furtak, Speyer am Rhein, Fed. Rep. of Germany; James Ahart, Blue Bell, Pa.

[73] Assignee: Isover Saint-Gobain, Courbevoie, France

[21] Appl. No.: 544,500

[22] Filed: Jun. 27, 1990

[30] Foreign Application Priority Data

Jun. 29, 1989 [EP] European Pat. Off. ..... 89.401.863.9

[51] Int. Cl.[5] ..... D04H 1/72

[52] U.S. Cl. ..... 19/304; 65/9; 425/83.1

[58] Field of Search ..... 19/299, 304; 65/4.4, 65/9; 162/217, 335, 348, 351, 354; 264/113, 510, 511, 518; 425/81.1, 83.1

[56] References Cited

U.S. PATENT DOCUMENTS

| | | | |
|---|---|---|---|
| 2,714,081 | 7/1955 | Burgon | 264/518 |
| 2,913,365 | 11/1959 | Osborne et al. | 19/302 X |
| 2,993,239 | 7/1961 | Heritage | 264/518 X |
| 3,071,822 | 1/1963 | Meiler | 264/518 |
| 3,509,604 | 5/1970 | Furbeck | 19/302 X |
| 3,546,898 | 12/1970 | Langlois et al. | 65/9 X |
| 3,787,194 | 1/1974 | Rayle et al. | 19/302 X |
| 3,810,817 | 5/1974 | Arledter | 162/301 |
| 3,961,397 | 6/1976 | Neuenschwander | 19/303 X |
| 4,154,649 | 5/1979 | Stotz et al. | 162/347 X |
| 4,353,686 | 10/1982 | Hosler et al. | 425/83.1 |
| 4,495,119 | 1/1985 | Chung | 264/518 X |

FOREIGN PATENT DOCUMENTS 8300267 9/1983 World Int. Prop. O. .

*Primary Examiner*—Werner H. Schroeder
*Assistant Examiner*—John J. Calvert
*Attorney, Agent, or Firm*—Oblon, Spivak, McClelland, Maier & Neustadt

[57] ABSTRACT

A collection process for collecting mineral wool fibers produced by an aligned plurality of fiber making machines includes the steps of entraining the fibers produced by each of the fiber making machines in a gas, drawing the gas through a gas permeable conveyor belt substantially aligned with the aligned plurality of fiber making machines so as to collect the fibers on a fiber/-gas separating surface defined by the conveyor, and advancing the conveyor with the collected fibers in a flow direction. The fibers from each of the fiber making machines is collected on the fiber/gas separating surface in a separate collection zone. The lengths of each of the collection zones increases along the flow direction. The resulting collected fibers are useful in forming a mat.

6 Claims, 2 Drawing Sheets

MINERAL FIBER COLLECTION PROCESS AND DEVICE

BACKGROUND OF THE INVENTION

1. Field of the Invention

The invention is concerned with techniques of collecting so-called insulating mineral fibers, particularly of glass fibers, with a view to separating, under the fiber making machines, the fibers and ambient gases—particularly induced gases or those used for drawing out the fibers—in order to manufacture a mineral wool mat.

2. Background of the Related Art

An important stage in manufacturing products based on mineral fibers such as glass fibers is their collection under the fiber making machines. This operation is intended specifically at separation of the fibers by air induction. This separation is carried out in a known manner by suction through a gas-permeable reception device impermeable to the fibers.

A standard type of collection device called a belt collector is described, for example, in U.S. Pat. 3,220,812 in which it is proposed to collect fibers from a series of fiber making machines on a single endless belt type conveyor permeable to gas and under which a vacuum chamber is placed, or better still several independent vacuum chambers. In this type of collection, the fiber making machines can be brought as close together as the respective limits of their sizes permit, which allows relatively short production lines. This point is fairly important considering that production lines can contain as many as 9 fiber machines or more, each fiber machine being around 600 mm in diameter, for example.

The bottom limit of product felt density is dictated primarily by problems of mechanical strength, which therefore allows manufacture of the lightest products possibly obtainable. However, obtaining heavy products poses many problems. The term heavy products is used to refer to products whose density is, for example, more than 2.5 kg/m2 in the case of glass wool products with fibers as small as 3 microns per 5 g, with the exception of dense products obtained by molding and pressing which do not come under the scope of this invention. This difficulty can easily be explained by the fact that the heavier the mat one attempts to produce, the greater the quantity of fibers deposited on a single surface area of the endless band, and therefore the greater the resistance to gas passage. To compensate for this reduced permeability, the negative pressure must be higher, which has the consequence of crushing the felt under pressure of the gases, such crushing being particularly noticeable at the bottom of the felt, i.e., the fibers collected first. Because of this, the mechanical performance of the product, particularly as regards regaining thickness after compression, is reduced. The resulting deterioration in quality is noticeable immediately when negative pressure is increased beyond 8000 to 9000 Pa, whereas in some installation a negative pressure of 10 000 Pa is necessary for mats with a density of 2500 g/m2.

To remedy this disadvantage, the gases may be drawn in only partially (i.e., only in certain areas) in order to limit negative pressure to a value which will not damage the felt, but there then occurs a phenomenon of fiber back flow in the direction of the fiber making machines for those areas not under suction. As well as being detrimental to good drawing out of the fibers, this back flow of gas causes an increase of temperature in the fiber making hood and thus a risk of pregellification of the binder: that is to say polymerization of the binder while the fibers are still separate filaments, which therefore virtually puts a stop to all its activity. In addition, this back flow can cause lumping, i.e., dense assemblies of conglomerated fibers harmful to the homogeneity and appearance of the product, and reduce its thermal resistance.

A reduction in speed of gas passage through the felts can be sought by spacing the fiber making machines apart from one another. However, any real gain is very slight since increasing the dimensions of the hood causes increased air induction and therefore an increase in the amount of air to be drawn out.

In European patent application EP-A-102 385, it was proposed to separate collection into two parts, each part receiving fibers produced by every other fiber making machine. In this case, collection is achieved by two conveyors facing one another in order to gather together the two half-felts formed. This type of collection has the advantage of providing products of good external appearance due to the presence on both faces of crusts glued together, which improves product mechanical strength. However, this collection device takes up more space than conventional collection devices and, for heavy densities, the binder sometimes polymerizes before the half-felts are brought together, thus causing the product to separate into layers.

This notion of sub-dividing the collection operations was set out elsewhere in U.S. Pat. No. 4,120,676 which proposes associating one collection unit with each fiber making machine, the production line thus being a juxtaposition of basic modules each producing a relatively thin felt, the different thin felts being later stacked to form a single very thick felt.

This modular design enables keeping fiber making conditions constant whatever the product being manufactured. However, the lightest products are therefore obtained with a production line used well under its theoretical capacity, which is not cost effective.

Another example of modularizing mineral wool production lines is the so-called drum-type collection devices in combination with a layer forming device. In this case, as shown in U.S. Pat. No. 2,785,728, reception occurs on drum type rotating parts. A low-density primitive is prepared by means of a collection device facing one or more fiber making machines, consisting of a pair of drums revolving in opposite directions whose perforated surface enables the gases to be drawn in by suitable devices located inside the drums. The primitive forms between the drums and falls down vertically before collection by the layer forming device, i.e., a pendular device which deposits the primitive in criss-cross layers onto a conveyor where the desired high density felt is obtained.

These modular collection device designs theoretically target a much wider range of products inasmuch as one always starts with a low density felt.

However, this requires a higher initial outlay with, in addition, a multiplication of the associated equipment (suction and washing devices in particular). Also, the means of separating the collection devices requires wide spacing of the fiber making machines, thus resulting in exceptionally long production lines as the number of fiber making machines is increased.

In addition, the likelihood of the product separating into layers and not being homogeneous limits the production of lower density felts. Thus, a lapping machine must have a primitive of at least 100 g/m2, below which its mechanical strength would be insufficient, particularly for withstanding the pendulum movements and a sufficient number of stacked layers, to obtain optimized distribution with the same number of layers at all points of the felt.

Also, always operating with the same yield of fibrous mass enables working in conditions encouraging the reproducibility of fiber making parameters and therefore their optimization, yet deprives the manufacturer of the fiber making machines the ability to process fibrous material at yields ranging, for example, from 1 to 10.

Lastly, for the same quality of fibers, a product of less density is marketed at a lower price. It would not appear very judicious to choose those conditions in which the production line produces the least tonnage.

SUMMARY OF THE INVENTION

An object of the invention is a new design of collection devices for the mineral wool felt production plant, aimed at widening the range of the products it is possible to manufacture with the same production line. This widening of the range extends in both low and high density directions in order to increase the flexibility of the production line, while retaining or even improving the quality of the products obtained. The range of product densities manufactured extends, for example, from 300 g to 4000 g/m2 or more if in conjunction with a lapping device.

The invention proposes a collection process for separating the fibers and gases produced by a set of fiber making machines with a view to obtaining a mineral wool mat, according to which the fibers are collected by drawing in gases through a gas permeable fiber/gas separating surface, each fiber making machine having its own collection zone Zi, the fibers collected in the different collection zones Zi being evacuated outside of the collection zone via one or more other zones Zi, wherein the surface areas of collection zones Zi increase with larger densities of product on the said conveyor belts.

In other words, the closer the fiber machine is to the final forming zone, the larger the collection zone allocated to it, which compensates for the greater resistance to the passage of gases due to deposition on the same conveyor belts of fibers from the fiber making machines furthest away.

The process advantageously operates at a constant back flow rate.

By back flow rate, we mean the percentage of gas not drawn in at collection level. Preferably, this rate is zero, and this is true even for the fiber making machines downstream of the line. The collection surfaces are preferably bordered on one side by the conveyor belts themselves because of the form of the collection belts. The increased resistance to gas passage is due to the deposition of fibers from the fiber making machines upstream (still considering a line oriented in the direction of the primitive feed). It must be noted that the collection devices according to the invention are reception devices common to several fiber making machines and preferably to 3 or more fiber making machines. The number of collection devices per production line therefore does not generally exceed two, which avoids the disadvantages of excessive modularization.

On the other hand, increasing the collection surface area in heavy density zones enables maintaining relatively low negative pressure levels in these, for example advantageously less than 4000 Pa, i.e. at a level well under the level at which one first observes damage in high quality fibers such as glass fibers whose fiber size is for example 3 microns per 5 g.

Advantageously, one can operate with the same level of negative pressure for all the collection surfaces. In other words, compensation is fully made from one collection zone to another. For the lesser permeability of the felt attributable to the thickness of the felt already deposited from the other fiber making machines and this without harming gas draw-in, for as indicated in the introduction, drawing in the gases at only part of the fiber/gas separating surface would lead to a back flow of fibers with all the formation of uneven lumps and therefore of a product of lesser quality.

This invention may use a flat conveyor belt, used mainly in installations already in use today. By flat belt, we mean one in which the part of the conveyor belt likely to be covered by the fibers consists of a flat portion having a horizontal trajectory. It goes without saying that the conveyor belt has a closed trajectory and is of endless belt type. However, its "return" section has no direct function in the way the fibers are collected. If a single belt is used, the increased density corresponds to the direction of feed of the conveyor belt: in this case one can number the n fiber making machines from 1 to n, so that fibers issuing from the first fiber making machine are the first to be deposited on the conveyor belt. According to the invention, $Z1<Z2<Zn$. Note that it is not necessary for Z to always increase; two adjacent zones - especially if they are upstream, and correspond to fairly low densities - can perhaps have the same surface area. However, it is preferable that the surface areas always increase.

According to a first embodiment of the invention, the increase in surface area of zones Zi is obtained by increasing the center distances of the fiber making machines. Thus the closer a machine is to the final place of fiber forming, the further it is from the adjacent fiber making machine or machines.

According to a second embodiment of the invention, the increase in surface area zones Zi is obtained by successively sloping the axes of rotation of the fiber making machines to obtain impact points increasingly far apart over the collection area.

Increasing the center distances of the fiber making machines is not without a number of negative secondary effects, among which are a longer production line and an increased quantity of air induced so that the larger collection area is partly offset from the start by the increased quantity of air to be drawn in.

One can also combine the embodiments having increased fiber machine slope and increased center distances, which avoids an over-long line or a very pronounced slope in the last fiber machine.

Preferably, the fiber machines are divided into groups of from example 3 or 4, forming as many collection modules as there are groups: each module therefore has its own associated primitive and all the primitives thus formed are then assembled before being transferred in the form of a single felt into the binder polymerization oven. Generally two collection modules at most are necessary even for high tonnage production lines.

Therefore collection is modularized, but in a manner voluntarily limited to much smaller proportions than in previous practice.

Depending on the case, collection modules can be laid out serially one after another with a single glass feed channel for all the fiber making channels, or in parallel with in this case as many molten glass feed channels as collection modules. Subsequently, the primitives are collected together by stacking in parallel layers or criss-cross layers, the choice between these two stacking methods being made according to the final product densities desired.

It can also be advantageous to install for each collection module not one but two opposite and symmetrical converging collection belts, the fibers deposited on one or the other belt being collected together in a single felt at the common extremity of the two collection belts.

As the power necessary to drive the collection belts depends on the mass of fibers deposited on each of these, it is preferable to divide the number of fiber making machines into equal parts for each collection band, which simplifies synchronizing the speeds of the two collection belts, synchronization being necessary to avoid the two formed primitives sliding one onto the other. In the event of an odd number of fiber making machines, the last fiber machine will preferably have a collection area shared between two collection belts, the symmetry of the torus of fiber issuing from a fiber machine enabling division into two equal parts if one chooses to mount the collection belts so that the plane of symmetry contains the axis of symmetry of the torus of the central machine. In this case, the fibers produced by the central fiber machine are deposited directly around the point of convergence of the belts, which helps to produce a single, homogeneous felt, since even in the absence of a central machine, two separate primitives must not be formed on a single reception module.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
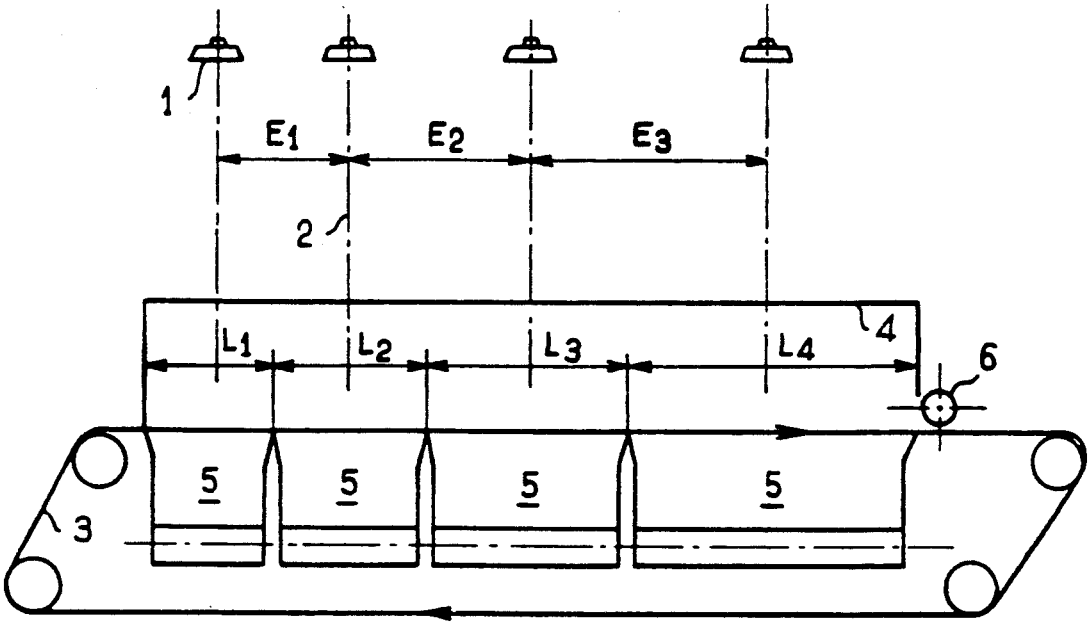
FIG. 1 is a schematic view of an installation according to the invention for a line with four fiber making machines with a center distance between machines increasing in the direction of collection belt feeding.

FIG. 1 corresponds to the first method of collection according to the invention, for a glass wool production line comprising four aligned fiber making machines 1 installed in a row. These fiber machines 1 consist, for example, of centrifuges revolving at high speed and equipped around their periphery with large number of orifices through which the molten material—preferably glass—escapes in the form of filaments which are then drawn out into fibers by concentric gas current, parallel to the centrifuge axis, emitted at high speed and temperature by a ring burner. Other fiber making devices known in the art may be used which enable forming a torus of fibers centered on an axis, the torus being formed by suction gases and above all gases induced in very great quantity.

Collection of the fibers—intended to separate these from the gases—is obtained by means of a fiber/gas separating surface in the form of a continuously driven, perforate, gas permeable endless belt 3 extending below the machines 1 and aligned with the row of machines. A hood 4 forms the lateral border of the fiber collection area. Gases are drawn in by independent vacuum chambers 5. Each fiber making machine 1 has its associated chamber 5. Also provided are the well known items of a conventional belt collection process, e.g., a pressure cylinder 6 applying pressure to the felt on leaving the collection device. The belt 3 advances the fibers thereon in a flow direction parallel to the row of machines 1.

In conformity with the invention, the closer the fiber making machines 1 are to the output of the belt 3, the further apart they are spaced. Thus from left to right, spacing is E1, E2 and E3 with $E1<E2<E3$, corresponding to the centers of chambers of lengths L1, L2, L3 and L4 such that $L1<L2<L3<L4$. The width of the endless belt being fixed, the collection zones therefore have increasing surface areas Z1, Z2, Z3 and Z4. The increased center distances therefore enable limiting increases in, or reducing, the values of negative pressure in the right hand chambers corresponding to heavy density zones.

The collection device comprises as many chambers as fiber making machines, but since the invention permits a homogenization of negative pressure values, it is possible to use chambers common to several fiber making machines. One can even use just one chamber for the entire row of machines 1.

Figure 2:
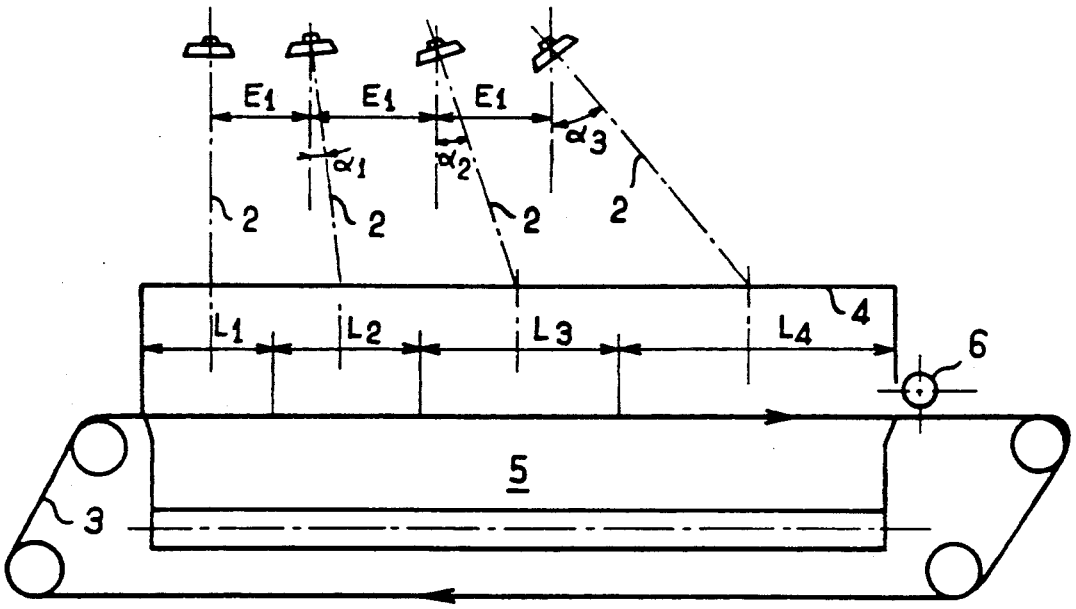
FIG. 2 is a schematic view of an installation according to the invention for a line with four fiber making machines with increasingly spaced points of impact obtained by progressively sloping the machines in the direction of collection belt feeding.

An alternative embodiment is shown in FIG. 2. In this case, the respective increase L1, L2, L3 and L4 in the lengths of the collection zones is obtained not by spacing the fiber making machines (e.g., four machines) further apart in the direction of collection belt feeding, but by sloping rotation axis 2 of the said machines at progressively increasing angles of $a1<a2<a3$, the center distance E1 between the machines remaining constant.

This alternative embodiment of the invention can advantageously be installed in an existing production plant, without extensive modifications to the molten glass supply circuits.

Preferably, the number of fiber making machines for one collection module is equal to 3 or 4, so that for a big production line, two collection modules will be used.

Figure 3:
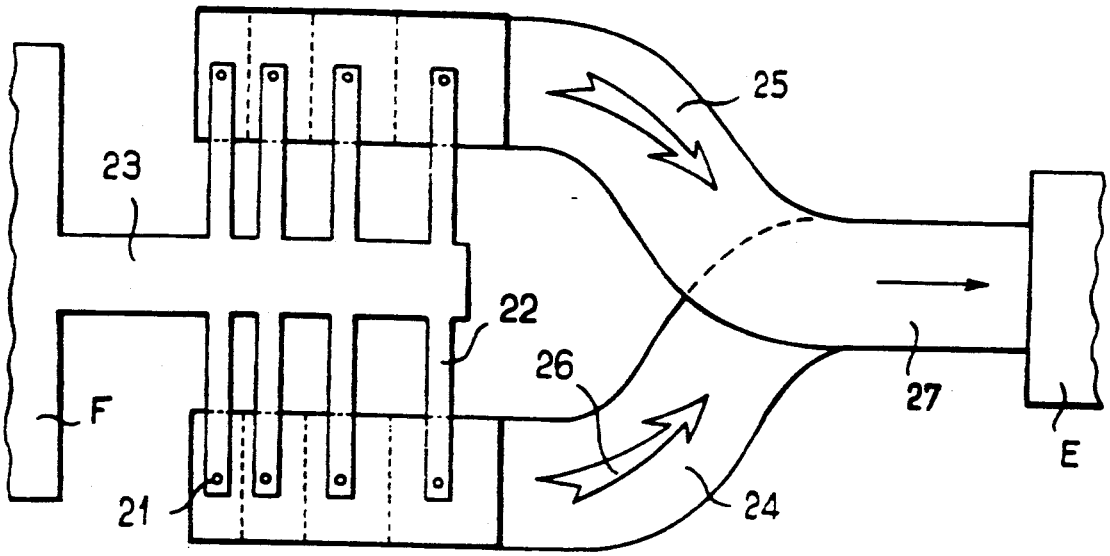
FIG. 3 is a perspective view of a line comprising 6 fiber making machines and two collection modules conforming to FIG. 1, with parallel assemblies of primitives.

FIG. 3 corresponds to a production line comprising eight fiber making machines 21 divided into two modules conforming to FIG. 1. These eight machines 21 are supplied with molten glass along pipes 22 from a central channel 23 leaving an oven F. Two primitives 24, 25 are formed in parallel, then brought together—by means of angle conveyors, not shown here, which re-orient the primitives in the direction indicated by arrows 26 into a single felt 27, before entering an oven E.

The performance of the collection devices conforming to the process according to the invention can be seen from results given in the table below:

| Test n° | 1 | 2 | 3 | 4 |
|---|---|---|---|---|
| Number of machines | 6 | 6 | 6 | 6 |
| Minimum center distance E in mm | 2000 | 1300 | 1500 | 1500 |
| Maximum center distance E in mm | 2000 | 1300 | 2000 | 2000 |
| Length head N° 3 in mm | 2000 | 1300 | 2650 | 2650 |
| Smoke output (%) | 100 | 83 | 103 | 104 |
| Maximum negative pressure (Pa) | 13140 | 14960 | 4890 | 8140 |

These tests were carried out on a production line comprising 6 centrifuge type fiber making machines with a yield of 20 tonnes per day of molten glass, these fiber machines being mounted in parallel and forming two individual collection devices each producing one primitive, the two primitives being collected and stacked in parallel layers.

The smoke yield base (100%) corresponds to a drawing gas and induced gases yield of 365–450 Nm3 per hour.

The two first tests correspond to conventional collection devices with fiber machines spaced at equal intervals of 2 meters, and suction lengths corresponding to these machines also being constant, which means that the 2 heads or machines at the end of the line (3rd head (i.e., head No. 3 of the Table) in relation to the collection belt forward direction) produce fibers received by a surface area of the same dimension as that corresponding to the machines upstream. To suck all the smoke (zero back flow), it is then necessary to have very high negative pressure levels (respectively equal to 13140 and 14960 Pa in the cases studied; these values correspond to a density of 2500 g/m2 for the final glass wool mat).

As indicated previously, such negative pressure levels are likely to lead to damage, particularly as regards the mechanical qualities of the insulating products. In addition, comparison of tests 1 and 2 demonstrates the difficulty of building a compact line with fiber machines spaced fairly close together.

Tests 3 and 4 correspond to implementation of the invention in accordance with FIG. 3, but with a reduced line of 6 fiber machines.

Increasing the center distances obtains a suction length in the highest density zone well over that of the previous examples. In these conditions, the maximum negative pressure level is only 4890 Pa–for a density of 2500 g/m2 (test n°3) and is only 8140 Pa for a density of 4000 g/m2 (test n°4), which remains a tolerable level.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Collection process for collecting mineral wool fibers produced by a plurality of fiber making machines in order to form a mat of said fibers, comprising the steps of:

entraining the fibers produced by each of the fiber making machines in a gas, collecting the fibers produced by each of said fiber making machines on a gas permeable fiber/gas separating surface by drawing the gas through said separating surface, said separating surface comprising a flat conveyor belt; and advancing said collected fibers in a flow direction, wherein said collecting step comprises applying the fibers produced by each of said fiber making machines to said separating surface in separate collection zones of said separating surface with a constant gas back flow rate, wherein surface areas of said separate collection zones increase along said flow direction.

2. Collection process for collecting mineral wool fibers produced by an aligned plurality of fiber making machines in order to form a mat of said fibers, comprising the steps of:

entraining the fibers produced by each of the fiber making machines in a gas, drawing said gas through a gas permeable conveyor belt substantially aligned with and below said aligned plurality of fiber making machines so as to collect the fibers on a fiber/gas separating surface defined by said conveyor; and advancing said conveyor with said collected fibers in a flow direction, wherein said drawing step comprises collecting fibers produced by each of said fiber making machines in separate collection zones of said separating surface, wherein the lengths of said separate collection zones increase along said flow direction, including the step of discharging fibers from said fiber making machines at progressively increasing angles, in the flow direction, with respect to vertical, so as to provide the increased lengths of said collection zones, whereby a suction pressure of said drawing step is substantially constant along said conveyor so that a back flow rate of the gas is substantially constant.

3. The process of claim 2 wherein said backflow rate is substantially zero.

4. The process of claim 2 wherein said drawing step comprises forming the collection zones defined by separate suction chambers beneath said conveyor belt.

5. The process of claim 2 including the step of combining plural layers of said collected fibers.

6. Collection process for collecting mineral wool fibers produced by an aligned plurality of fiber making machines in order to form a mat of said fibers, comprising the steps of:

entraining the fibers produced by each of the fiber making machines in a gas, drawing said gas through a gas permeable conveyor belt substantially aligned with and below said aligned plurality of fiber making machines so as to collect the fibers on a fiber/gas separating surface defined by said conveyor; and advancing said conveyor with said collected fibers in a flow direction, wherein said drawing step comprises collecting fibers produced by each of said fiber making machines in separate collection zones of said separating surface, wherein the lengths of said separate collection zones increase along said flow direction, including the step of discharging fibers from said fiber making machines whose spacing progressively increases in the flow direction so as to provide the increased lengths of said collection zones, whereby a suction pressure of said drawing step is substantially constant along said conveyor so that a back flow rate of the gas is substantially constant.

* * * * *